United States Patent [19]

Duret et al.

[11] Patent Number: 4,559,474

[45] Date of Patent: Dec. 17, 1985

[54] TRAVELLING WAVE TUBE COMPRISING MEANS FOR SUPPRESSING PARASITE OSCILLATIONS

[75] Inventors: Robert Duret, Maurepas; Dominique Henry, Elancourt, both of France

[73] Assignee: Thomson-CSF, Paris, France

[21] Appl. No.: 523,624

[22] Filed: Aug. 15, 1983

[30] Foreign Application Priority Data

Aug. 20, 1982 [FR] France ..... 82 14433

[51] Int. Cl.[4] ..... H01J 25/34

[52] U.S. Cl. ..... 315/3.6; 315/3.5; 315/39.3

[58] Field of Search ..... 315/3.6, 3.5, 39.3

[56] References Cited

U.S. PATENT DOCUMENTS

| | | | |
|---|---|---|---|
| 2,828,440 | 3/1958 | Dodds | 315/3.6 |
| 2,921,224 | 1/1960 | Tien | 315/3.6 |
| 2,971,114 | 2/1961 | Dow | 315/3.6 |
| 3,142,777 | 7/1964 | Sullivan | 315/3.6 |
| 3,666,984 | 5/1972 | Kantorowicz | 315/3.6 |
| 3,903,449 | 9/1975 | Scott et al. | 315/3.6 |
| 4,107,575 | 8/1978 | Vanderplaats et al. | 315/3.6 |
| 4,282,457 | 8/1981 | Harper | 315/3.6 |
| 4,296,354 | 10/1981 | Neubauer | 315/3.6 |
| 4,358,704 | 11/1982 | Conquest | 315/3.6 |

*Primary Examiner*—Saxfield Chatmon

*Attorney, Agent, or Firm*—Roland Plottel

[57] ABSTRACT

The invention provides a travelling wave tube comprising means for suppressing parasite oscillations and these means are formed by auxiliary helical delay lines placed inside the sleeve in the gaps between two adjacent dielectric supports, periodically fixed to the sleeve by metal supports and without contact with the main helical delay line.

7 Claims, 1 Drawing Figure

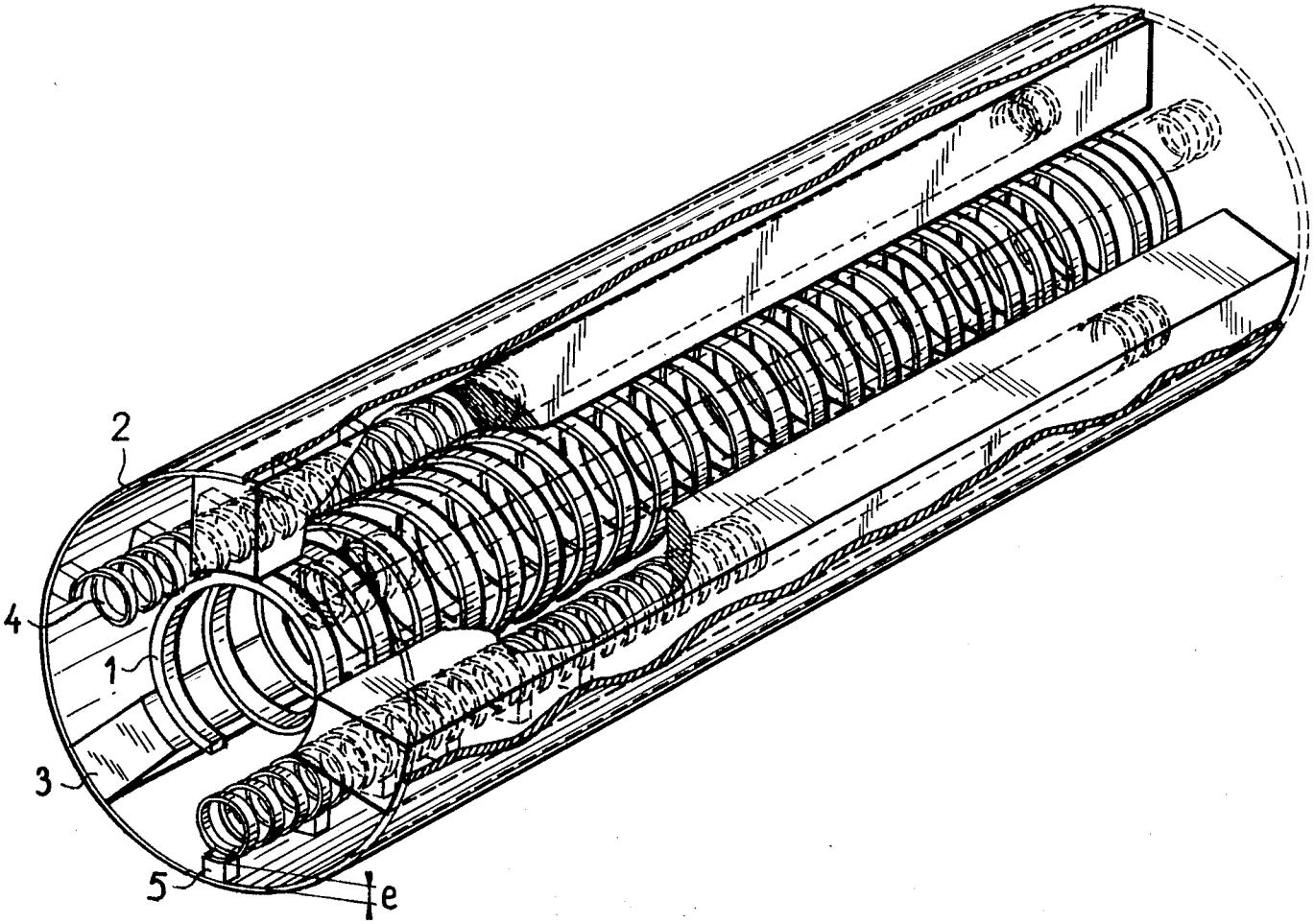
2
4
1
3
5
e

TRAVELLING WAVE TUBE COMPRISING MEANS FOR SUPPRESSING PARASITE OSCILLATIONS

BACKGROUND OF THE INVENTION

1. Field of the Invention

The present invention relates to a travelling wave tube comprising means for suppressing parasite oscillations.

2. Description of the Prior Art

The invention relates to the field of travelling wave tubes operating as amplifiers and having a delay line of the helical type, i.e. for example a delay line in the form of a single helix or a double helix.

The problem which arises with these tubes is to avoid the appearance of parasite oscillations in the reverse mode (or "carcinotron") or at cut-off, especially when the amplification is effected over a wide band and when the powers are high.

The present invention resolves this problem.

SUMMARY OF THE INVENTION

According to claim 1, the present invention relates to a travelling wave tube comprising means for suppressing parasite oscillations and this tube comprises a helical type delay line placed in a metal sleeve to which it is fixed by dielectric supports. The means for suppressing parasite oscillations are formed by at least one auxiliary delay line of the helical type placed inside the sleeve in one of the gaps between two adjacent dielectric supports, and periodically fixed to the sleeve by metal supports.

Among the numerous advantages of the invention may be mentioned:

the fact that the means for suppressing parasite oscillations which are used are light and compact and in particular require no increase in the dimensions of the sleeve:

the fact that these means are simple to construct and easily positioned;

the possibility of achieving variable coupling between auxiliary delay lines and the main delay line;

the fact that these means, which are formed by auxiliary helixes connected periodically to the sleeve by metal supports, does not modify the insulating properties of the dielectric supports of the main helix;

the fact that a high peak power may be reached without breakdown between the turns of the auxiliary helixes, for these helixes are in a vacuum.

BRIEF DESCRIPTION OF THE DRAWING

Other objects, features and results of the invention will be clear from the following description, given by way of non limiting example and illustrated by the accompanying FIGURE which is an exploded perspective view of one embodiment of a part of a tube in accordance with the invention.

In this FIGURE, the same references designate the same parts, but, for the sake of clarity, the sizes and proportions have not been respected.

DESCRIPTION OF THE PREFERRED EMBODIMENTS

In the single FIGURE which illustrates this description, an exploded perspective view has been shown of one embodiment of the invention.

In this FIGURE, a part of a helical delay line 1 may be seen belonging to a travelling wave tube. Neither the electron gun nor the collector of the travelling wave tube have been shown in the FIGURE for they are well known in the prior art. This delay line is fixed to a metal and cylindrical sleeve 2 by three dielectric supports 3.

For travelling wave tubes operating at relatively low power levels, the helix and the supports are assembled by clamping in the sleeve. The helix is made for example from tungsten and the supports from quartz, alumina, glucinium or boron nitride. The sleeve may be made from copper.

For travelling wave tubes operating at higher powers, the helix 1 is brazed to the dielectric supports 3 which are brazed to the sleeve 2.

The helix may then be made from copper, as well as the sleeve, and the dielectric supports may be made from beryllium oxide for example.

The metal sleeve 2 is connected to ground, so to the reference voltage of the tube.

In one embodiment of the invention, three auxiliary delay lines 4 may be seen, placed inside the sleeve, in each gap between two adjacent dielectric supports 3. These auxiliary delay lines are periodically fixed to sleeve 2 by metal supports 5. They are coupled to the main helix 1, but are not in material contact therewith. The auxiliary delay lines may be made from copper, molybdenum or tungsten for example and the metal supports may be made from platinum.

These three auxiliary delay lines, with periodic grounding, form means for suppressing parasite oscillations for they produce an attenuation which varies with the frequency; this attenuation is very high for the frequencies close to the cut-off frequency, at which parasite oscillations may occur and this attenuation is much smaller for the other operating frequencies.

The dimensions of the auxiliary helixes, i.e. the diameter of the wire which forms them, their pitch, their diameter . . . , as well as the dimensions of the metal supports are calculated so as to highly attenuate the frequency zone in which parasite oscillations may occur. This frequency zone may be accurately known. The auxiliary helixes form then resonating circuits. In general, the length of the auxiliary helixes which is comprised between two adjacent metal supports is substantially equal to half the wavelength of the frequency zone to be attenuated. However, this length is modified in particular so that there is a whole number of turns between two adjacent metal supports.

Thus, for example, in a particular case, the following dimensions have been obtained:

main helix:
- external diameter: 1.8 mm
- pitch: 1.15 mm sleeve:
- inner diameter: 4 mm auxiliary helix:
- external diameter: 0.585 mm
- pitch: 0.4 mm In this particular case, a metal support is provided in contact with each auxiliary helix every four pitches of this helix.

In the embodiment of the invention shown in the FIGURE, it can be seen that the ends of the auxiliary helixes are formed by grounded points, i.e. the auxiliary helixes finish by a part in contact with the metal supports 5.

A variable coupling may be provided between the auxiliary helixes and the main helix by varying the thickness of the metal supports 5.

Of course, the thickness of the metal supports 5 is such that there can be no contact between the main helix and the auxiliary helixes. There exists only coupling between these helixes but no material contact.

According to the invention, the means for suppressing parasite oscillations are formed then by one or more auxiliary delay lines connected periodically to the sleeve grounded by the metal supports; it should be noted that this structure allows the parasite oscillations to be suppressed without reducing the insulating properties of the dielectric supports, as would be the case if the suppression means were fixed to the dielectric supports. A reduction of the insulation properties of the dielectric supports limits the possibilities of peak power connection because of a risk of dielectric breakdown.

Finally, as has already been mentioned, the means for suppressing parasite oscillations in accordance with the invention are light, take up little space, are simple to construct and easily positioned. It may in particular be noted that it is not necessary, during assembly, to position the auxiliary helixes very accurately with respect to the main helix. Since the pitch of the auxiliary helixes is much smaller than that of the main helix, there is always several auxiliary helix turns between two successive turns of the main helix.

It should be noted that the invention applies to travelling wave tubes having a main helical delay line or derived from a helix. This delay line may be for example in the form of a double helix, i.e. formed of two identical helixes, starting from the same point and with reversed winding directions.

In so far as the auxiliary delay lines are concerned, they are of the helical type, i.e. in the form of a single helix, a double helix, of the ring and bar type or of the ring and loop type. . . . To form these auxiliary delay lines, delay lines are chosen of the helical type for they have an aerated structure which allows coupling with the main delay line.

The invention covers the embodiments where an auxiliary delay line is provided in each gap between two adjacent dielectric supports or only in some of these gaps. There may then be one, two, three and even a greater number of auxiliary helixes depending on the number of dielectric supports.

Similarly, the invention covers the embodiments where the auxiliary delay lines are present all along the main delay line or only over a part thereof, for example towards the output of the line which is a strong interaction zone.

We claim:

1. In a travelling wave tube comprising means for suppressing parasite oscillations, this tube comprising a helical type delay line placed in a metal sleeve to which it is fixed by dielectric supports, said means for suppressing parasite oscillations are formed by at least one auxiliary helical type delay line, placed inside the sleeve with each entirely within one of the gaps between two adjacent dielectric supports periodically fixed to the sleeve by metal supports and without contact with said delay line, the dimensions of the auxiliary delay lines and of the metal supports being calculated so as to attenuate the frequency zone in which parasite oscillations may occur.

2. The tube as claimed in claim 1, wherein said metal supports have a variable thickness.

3. The tube as claimed in claim 1, wherein the length of said auxiliary helix which is comprised between two adjacent metal supports is substantially equal to half the wavelength of the central frequency of the frequency zone attenuated by the auxiliary helix so as to suppress the parasite oscillations.

4. The tube as claimed in claim 1, wherein delay lines of the helical type are chosen from the single helix or double helix delay lines.

5. The tube as claimed in claim 1, wherein said auxiliary delay lines are present all along the main delay line.

6. The tube as claimed in claim 1, wherein said auxiliary delay lines are only present at the output of the main delay line.

7. The tube as claimed in claim 1, wherein there is an auxiliary delay line in each gap between two adjacent dielectric supports.

* * * * *